US011952170B2

(12) United States Patent
González Popoca et al.

(10) Patent No.: US 11,952,170 B2
(45) Date of Patent: Apr. 9, 2024

(54) CONTAINER WITH AN INNER DECORATIVE FIGURE AND ITS MANUFACTURING METHOD

(71) Applicant: Vitro, S.A.B. de C.V., Monterrey (MX)

(72) Inventors: Humberto González Popoca, Metepec (MX); Miguel Ángel Proa Pérez, Toluca (MX); Braulio Rosas Fernández, Mexico City (MX); Gustavo Bobadilla Cortés, Tenango del Valle (MX); Guillermo Perales Aldaco, Toluca (MX); Juan Picazo Ortega, Mexico City (MX); Miguel Ángel Ortiz Caravantes, Toluca (MX)

(73) Assignee: Vitro, S.A.B. de C.V., Nuevo León (MX)

( * ) Notice: Subject to any disclaimer, the term of this patent is extended or adjusted under 35 U.S.C. 154(b) by 0 days.

(21) Appl. No.: 17/262,481

(22) PCT Filed: Apr. 10, 2019

(86) PCT No.: PCT/MX2019/000033
§ 371 (c)(1),
(2) Date: Jan. 22, 2021

(87) PCT Pub. No.: WO2020/022872
PCT Pub. Date: Jan. 30, 2020

(65) Prior Publication Data

US 2021/0284389 A1 Sep. 16, 2021

(30) Foreign Application Priority Data

Jul. 25, 2018 (MX) ..... MX/a/2018/009111

(51) Int. Cl.
*B65D 23/14* (2006.01)
*A45D 34/02* (2006.01)
*A45D 34/00* (2006.01)

(52) U.S. Cl.
CPC ..... *B65D 23/14* (2013.01); *A45D 34/02* (2013.01); *A45D 2034/007* (2013.01); *A45D 2200/053* (2013.01); *B65D 2203/00* (2013.01)

(58) Field of Classification Search
CPC .... B65D 2203/00; B65D 23/14; B65D 23/08; B65D 21/248; B65D 2583/0427;
(Continued)

(56) References Cited

U.S. PATENT DOCUMENTS 1,647,175 A 11/1927 Grunberg
2,361,423 A * 10/1944 Snyder ..... A63H 33/22 40/410

(Continued)

FOREIGN PATENT DOCUMENTS

CN 202880161 U 4/2013
CN 203975399 U 12/2014

(Continued)

*Primary Examiner* — Ernesto A Grano
(74) *Attorney, Agent, or Firm* — The Webb Law Firm

(57) ABSTRACT

The present invention relates to a container with an inner decorative figure and its manufacturing method. The container has a container body having a top cover. The top cover has an outlet neck projecting from the central portion to engage a cap; and, a geometric or amorphous through-peripheral wall in the lower part of the container body. The through-peripheral wall has an external peripheral wall and an internal peripheral wall. The external peripheral wall has as a threaded section. A figure includes an upper section with the desired figure and a lower section. The lower section has a stop section to delimit the entrance of the figure towards the inside of the container; and, a lower cap that is coupled (Continued)

to the lower part of the container body to retain and maintain fixed the position of the lower section of the decorative figure.

7 Claims, 3 Drawing Sheets

(58) Field of Classification Search
CPC ..... B65D 81/36; B65D 1/0223; B65D 23/12; A45D 2200/053; A45D 2034/007; A45D 34/02; G09F 23/08
USPC ..... 215/230
See application file for complete search history.

(56) References Cited

U.S. PATENT DOCUMENTS 2,435,612 A * 2/1948 Snyder ..... B43M 9/00 40/406
3,975,845 A * 8/1976 Mellard ..... A63H 13/20 40/414
5,292,564 A 3/1994 Lee
5,769,680 A * 6/1998 Hoffman ..... A47G 19/2227 206/217
5,803,306 A * 9/1998 Lewis ..... A47G 19/2227 220/662
6,027,774 A 2/2000 Fine et al.
6,042,022 A * 3/2000 Rogozinski ..... B05B 11/0005 222/192
6,061,937 A * 5/2000 Meng ..... G09F 19/08 40/409
6,065,640 A 5/2000 Ho et al.
6,564,483 B1 * 5/2003 Hsu ..... G09F 19/02 40/409
7,097,069 B2 * 8/2006 Cavanagh ..... B65D 7/04 206/217
D629,714 S * 12/2010 Sicurelli ..... D11/128
D634,241 S * 3/2011 Sicurelli ..... D11/157
D634,242 S * 3/2011 Sicurelli ..... D11/157
8,002,129 B1 * 8/2011 Reyes ..... B65D 1/06 215/6
8,550,869 B2 * 10/2013 Koonce, Jr. ..... A63H 27/10 446/219
8,770,776 B1 * 7/2014 Yang ..... G09F 19/08 362/101
8,992,281 B2 * 3/2015 Lui ..... A63H 3/50 446/72
9,079,114 B2 * 7/2015 Efremenko ..... A63H 15/06
D820,043 S * 6/2018 Leslie-Shattenkirk ..... B65D 1/0276 D7/507
10,427,835 B1 * 10/2019 Leslie-Shattenkirk ..... B65D 41/04
10,577,164 B2 * 3/2020 Siskron, III ..... B65D 77/22
D894,757 S * 9/2020 Coon ..... D9/719
2002/0012689 A1 * 1/2002 Stillman ..... B65D 85/812 424/439
2002/0029501 A1 * 3/2002 Braun ..... G09F 3/0292 40/310
2003/0008144 A1 * 1/2003 Whitney ..... B32B 7/02 428/402
2004/0173559 A1 * 9/2004 Shih ..... B65D 23/08 215/12.2
2004/0217126 A1 * 11/2004 Lee ..... B65D 75/5883 222/78
2005/0104236 A1 5/2005 Chen
2005/0218102 A1 * 10/2005 Guilford, III ..... B65D 81/18 215/11.1
2006/0286892 A1 * 12/2006 Moomaw ..... G09F 15/00 446/220
2008/0160876 A1 * 7/2008 Hsu ..... G09F 19/02 446/220
2009/0275259 A1 * 11/2009 Yu ..... G09F 19/02 446/129
2010/0095570 A1 * 4/2010 Yu ..... G09F 19/08 40/410
2011/0024311 A1 * 2/2011 Swinford ..... B65D 23/12 206/221
2011/0166910 A1 * 7/2011 Marina ..... B65D 47/36 705/7.29
2011/0268838 A1 * 11/2011 Vondrasek ..... C12H 1/22 426/15
2012/0085675 A1 * 4/2012 Pedersen ..... B65D 75/366 206/525
2013/0186796 A1 * 7/2013 D'Hollander ..... B65D 51/245 206/457
2013/0269226 A1 * 10/2013 Volftsun ..... B65D 23/00 40/299.01
2015/0117930 A1 * 4/2015 Rasgon ..... A45D 34/045 401/129
2017/0326465 A1 * 11/2017 Mascarelli ..... B44C 5/005
2019/0133358 A1 * 5/2019 Clyde ..... A47G 19/2255
2019/0162979 A1 * 5/2019 Staton ..... B65D 25/54
2021/0060450 A1 * 3/2021 Guarino ..... B65D 81/36

FOREIGN PATENT DOCUMENTS

FR 2759976 A 8/1998
WO 9847810 A1 10/1998

* cited by examiner

CONTAINER WITH AN INNER DECORATIVE FIGURE AND ITS MANUFACTURING METHOD

CROSS-REFERENCE TO RELATED APPLICATIONS

This application is the United States national phase of International Application No. PCT/MX2019/000033 filed Apr. 10, 2019, and claims priority to Mexican Patent Application No. MX/a/2018/009111 filed Jul. 25, 2018, the disclosures of which are hereby incorporated by reference in their entirety.

FIELD OF THE INVENTION

The present invention relates to the production of glass containers and more specifically to a container with an inner decorative figure and its manufacturing method.

BACKGROUND OF THE INVENTION

Glass articles such as glass bottles are typically produced on glass article forming machines of the type that can include multiple similar individual forming sections, by the blow-blow process, while wide-mouth jars, glasses and other glass articles are produced in the forming machines known as series "E" and "F" by means of the press-blow process, in the so-called "hot mold".

In the process of manufacturing the containers by means of the blow-blow or blow press process, the glass in the form of gobs is introduced into a parison or pre-formed mold in the parison forming station, where, depending on the process, the gob settles through a blowing or vacuum process, to the bottom of the parison mold, to form the crown of the container. Then, once the crown of the container is formed, a counterblow is made to form a parison or preform of the container. Subsequently, the preform of the container is transferred by means of an inversion mechanism, with a 180 degrees movement of said parison mold, to a final blow mold of the deformed station or final blow, where the final shape is given to the container. Finally, the newly formed container is transferred by a pushing mechanism to a dead plate in the front of the machine and, later, it is carried by means of a conveyor belt to a tempering oven where it is decorated or packed.

Most of the containers for the beer, soft drink, perfumery and food industries are made using these processes.

However, in the case of containers for the perfumery industry, they require more design, since in addition to fragrance, they seek to highlight their product with a prominent form of packaging. That is, the packaging is presented to the consumer is one more element of market strategy and a key issue to connect the consumer. The container or bottle quickly tells us what perfume is in front of us, who is behind it and what values can be directly associated with them.

Therefore, the present invention refers to a new type of container that is composed of two or more pieces, which is assembled with a figure or decorative piece in its internal part.

The container with an inner decorative figure consisting mainly of:

A container body having a top cover, said top cover including an outlet neck projecting from the central portion to engage a cap or an atomizer; and, a geometric or amorphous shape through peripheral wall in the lower part of the container body, said geometric or amorphous shaped through peripheral-wall having an external peripheral wall and an inner peripheral wall, said external peripheral wall having a threaded section or whatever type of section for coupling by some method of closure;

- a figure or decorative piece including an upper section with the desired figure and a lower section or support base, said lower section or support base having a retainer section to delimit the entrance of the figure or decorative piece towards the inside of the container; and,
- a bottom cap or base that engages the lower part of the container body to retain and hold the position of the lower section or support base of the decorative figure.

OBJECTIVES OF THE INVENTION

It is therefore a first objective of the present invention, to provide a container with an inner decorative figure that allows to manufacture more attractive containers for the perfume industry.

It is another objective of the present invention, to provide a container with an inner decorative figure that allows the formation of containers of irregular shapes.

These and other objects and advantages of the present invention will be apparent to those skilled in the art from the following detailed description thereof.

DETAILED DESCRIPTION OF THE INVENTION

Figure 1:
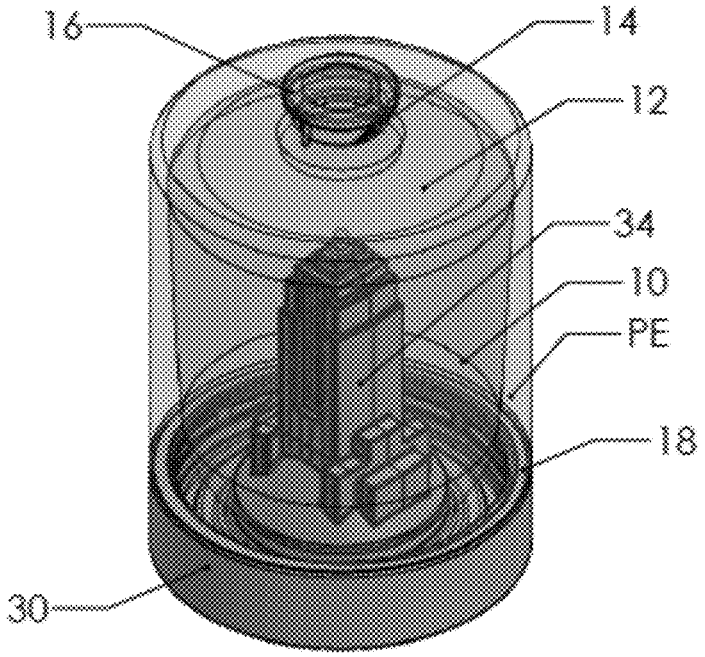
FIG. 1 is a conventional perspective view of a container with an inner decorative figure in accordance with the present invention.

Each of the parts of the container of the present invention will be described in detail below, according to FIGS. 1 to 3, which comprises: a first cylindrical body (10) that can have the shape of a prism, pyramid or cone truncated, cylindrical or of any amorphous shape, which has an upper cover (12). On the upper cover (12) it includes an outlet neck (14) that projects from the central part. Said outlet neck (14) has formed on its external circumference a threaded section or upper peripheral rim (16), for coupling a cap or an atomizer (not shown). The lower part (18) of the cylindrical body (10) includes a peripheral wall (20), which projects horizontally towards the inside of the container. In the lower part of the peripheral wall (20) a through-ring or peripheral wall (22) of geometric or amorphous shape is integrally formed, with a diameter or area slightly smaller than the first cylindrical body (10). The ring (22) having an external peripheral wall (26) which may include a threaded section or with a peripheral flange (28), for the base cover assembly (30), as will be described later; and, an internal through-peripheral wall (32) for the introduction of a decorative FIG. 34) to the internal part of the container.

Figure 2:
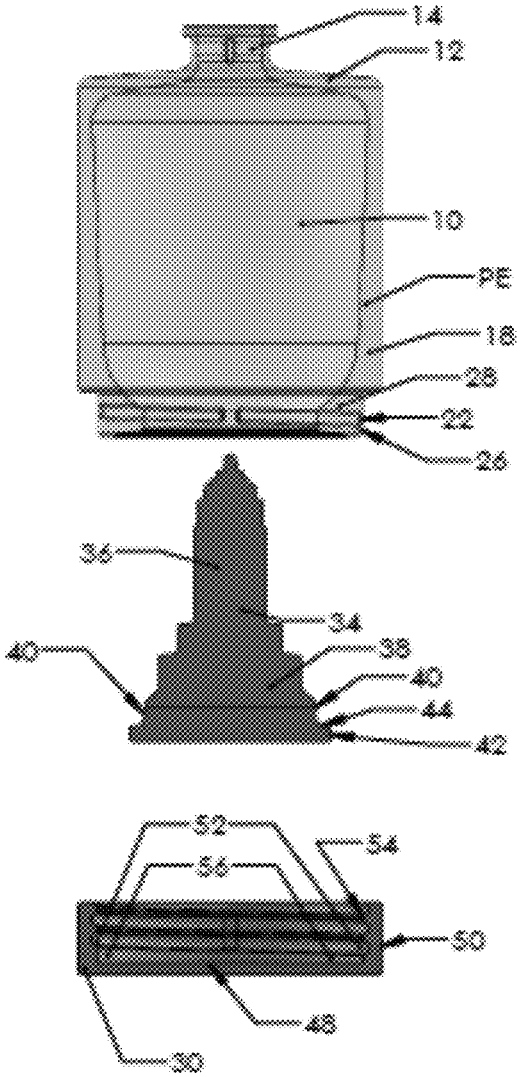
FIG. 2 is an exploded side view of the container with an inner decorative figure in accordance with the present invention; and, FIG. 3 is an assembled side view of the container with an inner decorative figure in accordance with the present invention.
Figure 3:
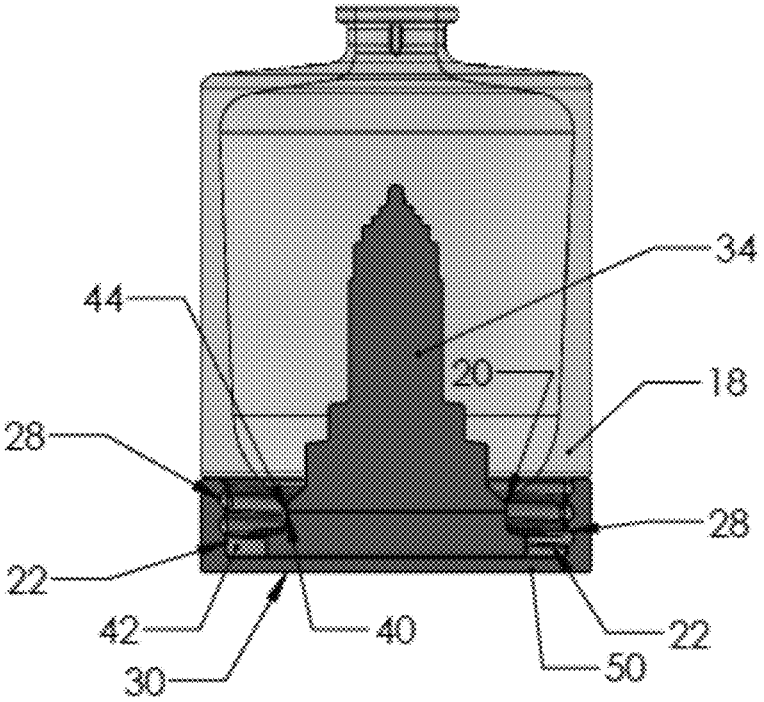

As shown in FIG. 2, the decorative piece (34), which can be of any shape, includes an upper section (36) with the desired figure (the figure of a building is shown in the example shown) and a lower section or support base (38).

The lower section or support base (38) having a first external peripheral wall (40) that engages, during the assembly of the decorative figure, coinciding with the internal part of the internal wall (32) of the through-ring or peripheral wall (22); and, a second peripheral or base wall (42) located at the bottom of said first peripheral wall (40). Said second peripheral or base wall (42) being of a diameter greater than said first external peripheral wall (40). The union of the first external peripheral wall (40) and the second peripheral wall or base plate (42) forming a stepped section (44), which serves as a stop when the decorative FIG. 34) is introduced towards the internal part of the container.

And, finally, the lower cover or base (30), which can also be cylindrical, triangular, square or of any amorphous shape, which includes a lower plate (48), an external peripheral wall (50), which it is projected vertically upwards and in linear coincidence, in the same plane, with the external wall (PE) of the first cylindrical body (10); and a first inner peripheral wall (52) having a threaded or closing coupling section (54) which, during assembly, is coupled with the threaded section or the section having the closing or coupling system (28) of the external peripheral wall (26) of the through-ring or peripheral wall (22); and, a second peripheral retaining wall (56), located on the inside of the lower cover or base (30) to retain and keep fixed the position of the lower section or support base (38) of the decorative FIG. 34).

As can be seen from the above, a method to manufacture a container with an inner decorative figure comprising the stages of:

forming a container body (10) with top cover (12), said top cover (12) including an outlet neck (14) projecting from the central part to engage a cap or an atomizer; and, a through-ring or peripheral wall (22) in the lower part of the container body (10), said ring (22) having an external peripheral wall (26) and an inner peripheral wall (32), said external peripheral wall (26) having a threaded section or a peripheral rim (28);

forming a figure or decorative piece (34) including an upper section with the desired decorative FIG. 36) and a lower section or support base (38), said lower section or support base having a stepped section or stop (44);

introducing the figure or decorative piece (34) into the internal part of the container body (10) through the central part of the through-ring or peripheral wall (22) until the stop section (44) of the lower section or base support coincides with a lower part of the ring or peripheral wall (22), to delimit the entrance of the figure or decorative piece (34) towards the internal part of the container; and, coupling a lower cover or base (30) to the external peripheral wall of the through-ring or peripheral wall (22) of the lower part (18) of the container body (10), to retain and maintain fixed the position of the lower section or support base (38) of the decorative FIG. 34).

The method of manufacturing a container with an inner decorative figure including the step of: hermetically sealing the junction of the lower section or support base (38) with the central part of the ring or peripheral wall (22) and, of the lower lid or base (30) with the external peripheral wall of the ring or of an amorphous FIG. 22) with the lower part of the container body (10).

It should be understood from the description of the present invention, that many other forms of containers can be manufactured under this concept, for example, the body of the container can be made of any geometric or amorphous figure, including its base that can be circular, triangular, square or an amorphous figure. Said lower cover or base and ring being coupled by thread or by means of a hermetic or sealing assembly process.

The invention claimed is:

1. A container with an inner decorative figure, comprising:

a container body having a top cover, said top cover including an outlet neck projecting from the central portion, the outlet neck having an opening extending therethrough configured to engage a cap or an atomizer, wherein the cap or atomizer is configured to close the opening; and, a geometric or amorphous through-peripheral wall in a lower part of the container body, said geometric or amorphous through-peripheral wall having an external peripheral wall and an internal peripheral wall, said external peripheral wall having a threaded section or a peripheral engagement flange;

a figure or decorative piece including an upper section with the figure or decorative piece and a lower section or support base, said lower section or support base having a first external peripheral wall to be assembled in contact with the internal peripheral wall of the through-peripheral wall geometric or amorphous shape and a second peripheral or base wall located at the bottom of said external peripheral wall, said second peripheral or base wall being of a diameter greater than said first external peripheral wall, wherein a union of the first external peripheral wall and the second peripheral wall or base wall forms a stepped section forming a stop to delimit the entrance of the figure or decorative piece towards the inside of the container; and, a lower cap or base that is coupled to the lower part of the container body to retain and maintain fixed the position of the lower section or support base of the figure or decorative piece, the lower cap or base having an external peripheral wall projecting vertically upwards and in linear coincidence and in the same plane with an external wall of the container body, the external peripheral wall having an outer surface forming an external surface and an inner surface, opposite to and integral with the outer surface, the inner surface comprising a first inner peripheral wall having a threaded or closing coupling section for coupling with the threaded section of the lower section or support base and a second peripheral retaining wall located on an inside of the lower cover or base to retain and maintain fixed the position of the lower section or support base of the figure or decorative piece.

2. The container with an inner decorative figure according to claim 1, wherein the body of the container has a shape selected from the group consisting of a prism, pyramid, truncated cone, cylinder, and any amorphous shape.

3. The container with an inner decorative figure according to claim 1, wherein the lower cap or base includes a lower plate having a flat portion that enables the container to rest in an upright position.

4. A method for manufacturing a container with an inner decorative figure comprising the steps of:

forming a container body with a top cover, said top cover including an outlet neck projecting from a central portion, the outlet neck having an opening extending therethrough configured to engage a cap or an atomizer, wherein the cap or atomizer is configured to close the opening; and, a through-ring or peripheral wall in a lower part of the container body, said through-ring or peripheral wall having an external peripheral wall and an internal peripheral wall, said external peripheral wall having a threaded section or peripheral sealing lip;

forming a figure or decorative piece including an upper section with the figure or decorative piece and a lower section or support base, said lower section or support base having a first external peripheral wall to be assembled in contact with an internal peripheral wall of the through-ring or peripheral wall of the container body and a second peripheral or base wall located at the bottom of said external peripheral wall, said second peripheral or base wall being of a diameter greater than said first external peripheral wall, wherein a union of the first external peripheral wall and the second peripheral wall or base wall forms a stepped section forming a stop;

introducing the figure or decorative piece into an internal part of the container body through a central part of the through-ring or peripheral wall until the stop of the lower section or base support coincides with a lower part of the through-ring or peripheral wall, to delimit the entrance of the figure or decorative piece towards the internal part of the container; and coupling a bottom cap or base to the external peripheral wall of the through-ring or peripheral wall of the lower part of the container body, wherein the bottom cap or base has an external peripheral wall projecting vertically upwards and in linear coincidence and in the same plane with an external wall of the container body, the external peripheral wall having an outer surface forming an external surface and an inner surface, opposite to and integral with the outer surface, the inner surface comprising a first inner peripheral wall having a threaded or closing coupling section for coupling with the threaded section of the lower section or support base and a second peripheral retaining wall located on an inside of the lower cover or base to retain and maintain fixed the position of the lower section or supporting base of the figure or decorative piece.

5. The method for manufacturing the container with an inner decorative figure in accordance with claim 4, including the step of: hermetically sealing a union of the lower section or support base with the central part of the through-ring or peripheral wall and, of the bottom cap or base with the external peripheral wall of the through-ring or peripheral wall or of an amorphous figure with a bottom of the container body.

6. A container with an inner decorative figure, comprising:

a container body having a top cover, said top cover including an outlet neck projecting from the central portion, the outlet neck including an opening extending therethrough; and, a geometric or amorphous through-peripheral wall in a lower part of the container body, said geometric or amorphous through-peripheral wall having an external peripheral wall and an internal peripheral wall, said external peripheral wall having a threaded section or a peripheral engagement flange;

a figure or decorative piece including an upper section with the figure or decorative piece and a lower section or support base, said lower section or support base having a first external peripheral wall to be assembled in contact with the internal peripheral wall of the through-peripheral wall geometric or amorphous shape and a second peripheral or base wall located at the bottom of said external peripheral wall, said second peripheral or base wall being of a diameter greater than said first external peripheral wall, wherein a union of the first external peripheral wall and the second peripheral wall or base wall forms a stepped section forming a stop to delimit the entrance of the figure or decorative piece towards the inside of the container;

a cap or an atomizer cooperating with the outlet neck to close the opening; and a lower cap or base that is coupled to the lower part of the container body, the lower cap or base having an external peripheral wall projecting vertically upwards and in linear coincidence and in the same plane with an external wall of the container body, the external peripheral wall having an outer surface forming an external surface and an inner surface, opposite to and integral with the outer surface, the inner surface comprising a first inner peripheral wall having a threaded or closing coupling section for coupling with the threaded section of the lower section or support base and a second peripheral retaining wall located on an inside of the lower cover or base to retain and maintain fixed the position of the lower section or support base of the figure or decorative piece.

7. The container with an inner decorative figure according to claim 6, wherein the lower cap or base includes a lower plate having a flat portion that enables the container to rest in an upright position.

* * * * *